United States Patent [19]

Haas

[11] 3,968,911

[45] July 13, 1976

[54] INFANT CARRIER

[76] Inventor: Marta Haas, 2275 Nelson Place, Lakewood, Colo. 80215

[22] Filed: Jan. 2, 1975

[21] Appl. No.: 537,773

[52] U.S. Cl. ..... 224/6; 297/192; 5/336

[51] Int. Cl.[2] ..... A47D 13/02

[58] Field of Search ..... 224/49, 45 L, 12, 11, 224/6, 58; 294/74; 5/82, 336, 345 B; 297/188, 192, 252, 17

[56] References Cited

UNITED STATES PATENTS

| | | | |
|---|---|---|---|
| 1,061,259 | 5/1913 | Blofield et al. | 5/336 |
| 1,348,818 | 8/1920 | Mac Callum | 224/6 |
| 1,462,897 | 7/1923 | Banto | 224/49 |
| 1,934,615 | 11/1933 | Selverstone | 297/188 |
| 2,525,713 | 10/1950 | North | 5/336 |
| 2,597,948 | 5/1952 | Phillips | 224/6 |
| 2,804,249 | 8/1957 | Manalo | 224/6 |
| 3,269,621 | 8/1966 | Dishart | 224/6 |
| 3,366,294 | 1/1968 | Stephenson | 224/6 |
| 3,575,326 | 4/1971 | Chappell | 224/6 |
| 3,610,490 | 10/1971 | Smith | 224/12 |

*Primary Examiner*—Frank E. Werner
*Assistant Examiner*—Kenneth Noland
*Attorney, Agent, or Firm*—Phillip L. DeArment

[57] ABSTRACT

The infant carrier and mattress comprises a planar resilient foam-filled mattress being substantially longer and wider than an infant and which has carrying straps stitched to each longitudinal side of the mattress. The infant receiving mattress surface has an additional layer of material stitched along opposite longitudinal sides and open at each lateral side to permit insertion therein of infant accessories. A harness stitched to the additional mattress layer and upper mattress surface secures the infant to the mattress. To carry an infant, an arm is inserted through the straps causing the mattress to bow about a longitudinal axis partially enveloping the infant.

4 Claims, 4 Drawing Figures

INFANT CARRIER

The present invention relates to a device which functions as an infant carrier and as a comfortable mattress for the infant.

An object of the present invention is to provide a new and improved infant carrier and mattress which is simple in design, attractive, light in weight, safe and convenient to use and relatively inexpensive to manufacture.

A further object is to provide an infant carrier and mattress which includes on the infant receiving surface an accessible pocket for storing supplies and accessories for the infant.

These and other objects of the inventions will become apparent in the following detailed description of the invention considered with the accompanying drawings and in which.

Figure 1:
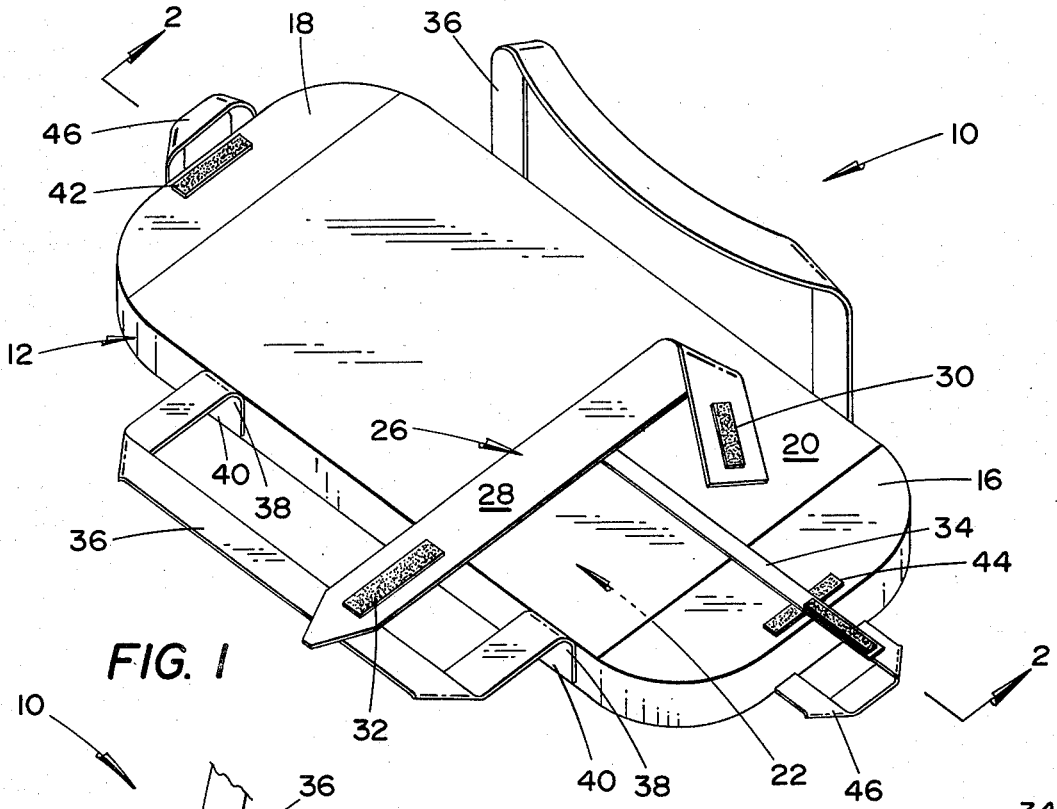
FIG. 1 is a perspective view of an infant carrier and mattress according to the present invention.
Figure 2:
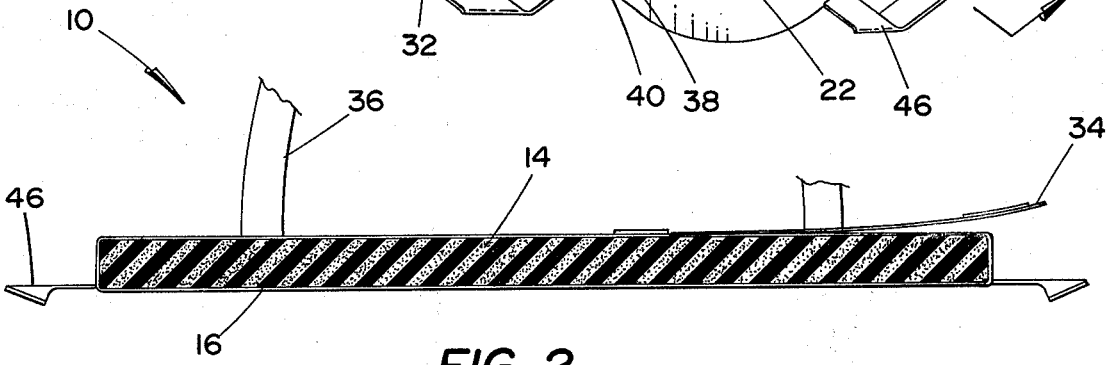
FIG. 2 is a sectional view taken approximately along line 2—2 of Figure.

Referring to FIG. 1, an infant carrier and mattress 10 is illustrated ready to receive an infant. The carrier 10 comprises an elongated mattress portion 12. As seen in FIG. 2, the mattress portion 12 comprises a resilient foam pad 14 covered by a water proof covering 16 such as oil cloth or plastic. Covering 16 is preferrably stitched to completely surround foam pad 14.

The infant receiving side 18 of mattress portion 12 further includes an additional layer of material 20 that terminates short of the ends of mattress portion 12 and is stitched to covering 16 along opposite longitudinal sides as illustrated in the drawing. This arrangement provides pocket 22 between covering 16 and material 20 which is accessible from each end to store infant supplies such as diapers, bib, bottles, etc.

Infant securing means 26 secures the infant to mattress portion 12. Infant securing means 26 comprises an elongated member or strap 28 stitched at its midportion to material 20 and covering 16. The two free ends of member 28 may include as securing means, "Velcro" hooks and eyelette pads 30, 32. A second member or strap 34 is secured at one end to covering 16 beneath strap member 28 by the same stitching that secures member 28 to covering 16.

Figure 3:
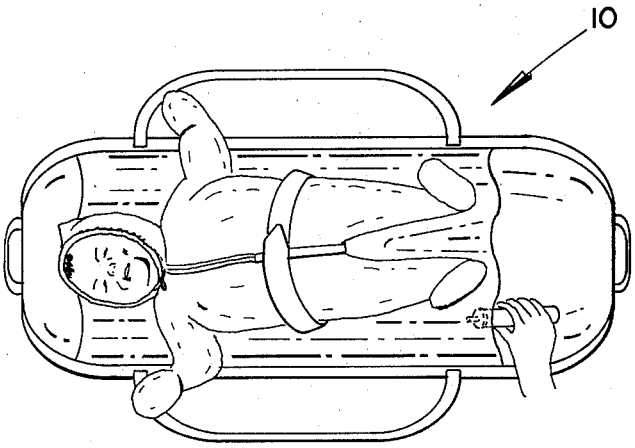
FIG. 3 is a plan view of the infant carrier and mattress illustrating an infant secured thereto ready for carrying.

Strap 28 and 34 are arranged as illustrated in FIG. 1 and the infant is placed on its back on the straps. Strap 34 is moved up between the infant's legs. The free end is positioned between the pads 30, 32 of strap 28 as the ends of strap 28 are overlapped after being wrapped snugly around the infant's waist as illustrated in FIG. 3.

Mattress portion 12 is carried by carrying straps 36. Opposite ends of straps 36 are double stitched at 38, 40 to covering 16. The double stitch arrangement provides a safe, redundant connection to covering 16. If one of the stitching 38, 40 breaks, the other is of adequate strength to support the infant while being carried.

Figure 4:
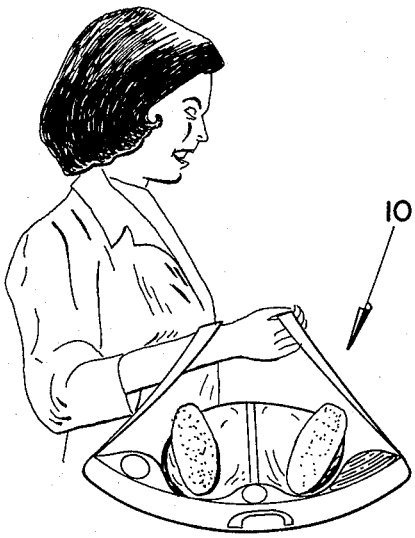
FIG. 4 is a perspective view of the infant carrier and mattress illustrating the infant being carried.

FIG. 4 illustrates the shape of carrier 10 as an infant is being carried therein. The dimensions of mattress portion 12 are such as to permit it to cradle the infant by snugly engaging the back and sides of the infant similar to a hammock. This is comfortable for the infant and prevents it from sliding relative to the mattress. The infant supplies such as diapers, bottles, food, etc. are inserted into the side areas of pocket 22 as illustrated in FIGS. 3 and 4. This supply placement also contributes to maintaining the infant central of mattress portion 18.

When carrier 10 is not in use it can be folded about a transverse axis and secured in this position by any suitable connectors such as Velco pads 42, 42. The folded carrier can then be carried by cooperating straps 46. The folded carrier can be stored by hanging straps 46 over a hook.

Having described my invention, I claim:

1. An infant carrier and mattress comprising a substantially planar pad of resilient material having a length and width substantially larger than an infant and having a thickness such that said pad defines a mattress which assumes a flat configuration for supporting an infant at rest thereon and deforms about the longitudinal axis thereof to partially surround the infant when carried thereon, a water proof covering enclosing said resilient material, a pair of carrying straps connected to each of the respective longitudinal sides of said mattress cover for carrying the infant when supported on the covered mattress, strap means for securing the infant to said cover of said mattress, and a layer of material stitched to said covering along the longitudinal sides thereof only and having a length less than the length of said mattress and said cover and being accessible from opposite ends of said covered mattress to thereby define an open ended pocket between said layer of material and said covering for carrying accessories and supplies required by the infant, whereby the supplies and accessories may be disposed within said pocket on opposite sides of the infant being carried to thereby maintain the infant centrally of the mattress and cover while the infant rests on the outer side of said layer of material.

2. An infant carrier and mattress as defined in claim 1 further including means for securing the ends of each carrying strap to longitudinally spaced areas along each longitudinal side of said mattress, each of said ends being stitched to said mattress at two spaced locations to provide a safe redundant connection.

3. An infant carrier and mattress as defined in claim 1 further including means for securing the opposite ends of said mattress in juxtaposition and cooperating straps secured to each of said ends to carry the folded mattress.

4. An infant carrier and mattress as defined in claim 1 wherein the means for securing the infant to the mattress includes first and second cooperating, transversely related straps secured to said material, said first strap having two free ends and adapted to wrap around the midsection of the infant and said second strap having one free end adapted to extend between the infant's legs, and connector means for securing the two free ends of said first strap and the free end of said second strap to secure the infant to said mattress.

* * * * *